US010215411B2

(12) United States Patent
Tu et al.

(10) Patent No.: US 10,215,411 B2
(45) Date of Patent: Feb. 26, 2019

(54) COMBUSTOR PANELS HAVING RECESSED RAIL

(71) Applicant: United Technologies Corporation, Farmington, CT (US)

(72) Inventors: John S. Tu, West Hartford, CT (US); James B. Hoke, Tolland, CT (US); David Kwoka, South Glastonbury, CT (US); Jonathan Jeffery Eastwood, Vernon, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 319 days.

(21) Appl. No.: 15/062,440

(22) Filed: Mar. 7, 2016

(65) Prior Publication Data

US 2017/0254538 A1 Sep. 7, 2017

(51) Int. Cl.

| | |
|---|---|
| ***F23R 3/00*** | (2006.01) |
| ***F23R 3/06*** | (2006.01) |
| ***F23M 5/08*** | (2006.01) |
| ***F23R 3/04*** | (2006.01) |

(Continued)

(52) U.S. Cl.

CPC ..... *F23R 3/002* (2013.01); *F23M 5/00* (2013.01); *F23M 5/04* (2013.01); *F23M 5/08* (2013.01); *F23M 5/085* (2013.01); *F23R 3/005* (2013.01); *F23R 3/04* (2013.01); *F23R 3/06* (2013.01); *F05D 2240/15* (2013.01); *F05D 2260/201* (2013.01); *F23R 2900/00005* (2013.01);

(Continued)

(58) Field of Classification Search

CPC ..... F02C 7/18; F02C 7/24; F05D 2240/15; F05D 2240/35; F05D 2260/201; F05D 2260/941; F23M 5/00; F23M 5/02; F23M 5/04; F23M 5/08; F23M 5/085; F23M 2900/05005; F23R 3/002; F23R 3/005; F23R 3/007; F23R 3/04; F23R 3/06; F23R 3/08; F23R 3/50; F23R 2900/00018; F23R 2900/03044

See application file for complete search history.

(56) References Cited

U.S. PATENT DOCUMENTS 4,446,693 A * 5/1984 Pidcock ..... F23R 3/002 60/757
5,758,503 A * 6/1998 DuBell ..... F23R 3/002 60/752

(Continued)

*Primary Examiner* — Scott J Walthour
(74) *Attorney, Agent, or Firm* — Cantor Colburn LLP

(57) ABSTRACT

A combustor of a gas turbine engine including a combustor shell having an interior surface, a first panel mounted to the interior surface at a first position and a second panel mounted to the interior surface at a second position. The first panel has a first end, a first combustion chamber surface parallel with the interior surface, a first rail extending from the first combustion chamber surface toward the interior surface of the combustor shell, and a first extension extending axially from the first rail to the end of the first panel. The second panel has a second end, a second combustion chamber surface, and a second rail extending from the second combustion chamber surface toward the interior surface of the combustor shell. The first end and the second end are proximal to each other and define a circumferentially extending gap there between.

12 Claims, 5 Drawing Sheets

(51) Int. Cl.
*F23M 5/00* (2006.01)
*F23M 5/04* (2006.01)

(52) U.S. Cl.
CPC ..... *F23R 2900/00017* (2013.01); *F23R 2900/03041* (2013.01); *F23R 2900/03044* (2013.01)

(56) References Cited

U.S. PATENT DOCUMENTS

| | | | | |
|---|---|---|---|---|
| 2005/0022531 | A1* | 2/2005 | Burd | F23R 3/002 60/752 |
| 2005/0086940 | A1* | 4/2005 | Coughlan, III | F23R 3/002 60/752 |
| 2011/0185740 | A1* | 8/2011 | Dierberger | F23M 5/02 60/755 |

* cited by examiner

COMBUSTOR PANELS HAVING RECESSED RAIL

BACKGROUND

The subject matter disclosed herein generally relates to panels for combustors and, more particularly, to panels for combustors having recessed rails.

A combustor of a gas turbine engine may be configured and required to burn fuel in a minimum volume. Such configurations may place substantial heat load on the structure of the combustor. Such heat loads may dictate that special consideration is given to structures which may be configured as heat shields or panels configured to protect the walls of the combustor, with the heat shields being air cooled. Even with such configurations, excess temperatures at various locations may occur leading to oxidation, cracking, and high thermal stresses of the heat shields or panels. As such, impingement and convective cooling of panels of the combustor wall may be used. Convective cooling may be achieved by air that is trapped between the panels and a shell of the combustor. Impingement cooling may be a process of directing relatively cool air from a location exterior to the combustor toward a back or underside of the panels. Leakage of impingement cooling air may occur through or between adjacent panels at gaps that exist between the panels. However, ingestion of air from the combustor (e.g., hot air) may be forced through the gap, which may lead to increased thermal stresses at the gap.

SUMMARY

According to one embodiment, a combustor of a gas turbine engine is provided. The combustor includes a combustor shell having an interior surface and defining a combustion chamber having an axial length and a first panel mounted to the interior surface at a first position and a second panel mounted to the interior surface at a second position and axially adjacent to the first panel. The first panel has a first end, a first combustion chamber surface extending axially from the first end of the first panel within the combustion chamber, the first combustion chamber surface being parallel with the interior surface, a first rail extending from the first combustion chamber surface toward the interior surface of the combustor shell, and a first extension extending axially from the first rail to the end of the first panel. The second panel has a second end, a second combustion chamber surface, and a second rail extending from the second combustion chamber surface toward the interior surface of the combustor shell. The first end and the second end are proximal to each other and define a circumferentially extending gap there between.

In addition to one or more of the features described above, or as an alternative, further embodiments of the combustor may include that the second panel includes a second extension extending axially from the second rail to the second end of the second panel.

In addition to one or more of the features described above, or as an alternative, further embodiments of the combustor may include that the first rail, the second rail, the first extension, and the second extension collectively define an impingement cooling volume at the circumferentially extending gap.

In addition to one or more of the features described above, or as an alternative, further embodiments of the combustor may include that the first rail has a length of a first distance extending a distance from the first combustion chamber surface toward the interior surface of the combustor shell, and the first extension has a length of a second distance, wherein the second distance is between one quarter and seven times the first distance.

In addition to one or more of the features described above, or as an alternative, further embodiments of the combustor may include that the first extension has a length of between 0.08 inches (0.20 cm) and 0.12 inches (0.31 cm).

In addition to one or more of the features described above, or as an alternative, further embodiments of the combustor may include a plurality of first panels and a plurality of second panels, wherein adjacent panels of the plurality of first panels and adjacent panels of the plurality of second panels define axially extending gaps between two circumferentially adjacent panels.

In addition to one or more of the features described above, or as an alternative, further embodiments of the combustor may include that each of the first panels includes at least one axially extending rail that extends from the first rail along the axially extending gap.

In addition to one or more of the features described above, or as an alternative, further embodiments of the combustor may include that the combustor shell includes at least one impingement aperture formed therein proximate the circumferentially extending gap.

According to another embodiment, a gas turbine engine is provided. The gas turbine engine includes a combustor including a combustor shell having an interior surface and defining a combustion chamber having an axial length, a first panel mounted to the interior surface at a first position, and a second panel mounted to the interior surface at a second position and axially adjacent to the first panel. The first panel has a first end, a first combustion chamber surface extending axially from the first end of the panel within the combustion chamber, the first combustion chamber surface being parallel with the interior surface, a first rail extending from the first combustion chamber surface toward the interior surface of the combustor shell, and a first extension extending axially from the first rail to the first end of the first panel. The second panel has a second end, a second combustion chamber surface, and a second rail extending from the second combustion chamber surface toward the interior surface of the combustor shell. The first end and the second end are proximal to each other and define a circumferentially extending gap there between.

In addition to one or more of the features described above, or as an alternative, further embodiments of the gas turbine engine may include that the second panel includes a second extension extending axially from the second rail to the second end of the second panel.

In addition to one or more of the features described above, or as an alternative, further embodiments of the gas turbine engine may include that the first rail, the second rail, the first extension, and the second extension collectively define an impingement cooling volume at the circumferentially extending gap.

In addition to one or more of the features described above, or as an alternative, further embodiments of the gas turbine engine may include that the first rail has a length of a first distance extending a distance from the first combustion chamber surface toward the interior surface of the combustor shell, and the first extension has a length of a second distance, wherein the second distance is one quarter and seven times the first distance.

In addition to one or more of the features described above, or as an alternative, further embodiments of the gas turbine engine may include that the first extension has a length of between 0.08 inches (0.20 cm) and 0.12 inches (0.31 cm).

In addition to one or more of the features described above, or as an alternative, further embodiments of the gas turbine engine may include a plurality of first panels and a plurality of second panels, wherein adjacent panels of the plurality of first panels and adjacent panels of the plurality of second panels define axially extending gaps between two circumferentially adjacent panels.

In addition to one or more of the features described above, or as an alternative, further embodiments of the gas turbine engine may include that each of the first panels includes at least one axially extending rail that extends from the first rail along the axially extending gap.

In addition to one or more of the features described above, or as an alternative, further embodiments of the gas turbine engine may include that the combustor shell includes at least one impingement aperture formed therein proximate the circumferentially extending gap.

According to another embodiment, a method of manufacturing a combustor of a gas turbine engine is provided. The method includes mounting a first panel mounted to an interior surface of a combustion chamber shell at a first position and mounting a second panel mounted to the interior surface at a second position and axially adjacent to the first panel. The first panel includes a first end, a first combustion chamber surface extending axially from the first end of the first panel within the combustion chamber, the first combustion chamber surface being parallel with the interior surface, a first rail extending from the first combustion chamber surface toward the interior surface of the combustor shell, and a first extension extending axially from the first rail to the first end of the first panel. The second panel has a second end, a second combustion chamber surface, and a second rail extending from the second combustion chamber surface toward the interior surface of the combustor shell. The first end and the second end are proximal to each other and define a circumferentially extending gap there between.

In addition to one or more of the features described above, or as an alternative, further embodiments of the method may include that the second panel includes a second extension extending axially from the second rail to the second end of the second panel.

In addition to one or more of the features described above, or as an alternative, further embodiments of the method may include that the first rail has a length of a first distance extending a distance from the first combustion chamber surface toward the interior surface of the combustor shell, and the first extension has a length of a second distance, wherein the second distance is between one quarter and seven times the first distance.

In addition to one or more of the features described above, or as an alternative, further embodiments of the method may include that the combustor shell includes at least one impingement aperture formed therein proximate the circumferentially extending gap.

In addition to one or more of the features described above, or as an alternative, further embodiments of the method may include that the first extension has a length of between 0.08 inches (0.20 cm) and 0.12 inches (0.31 cm).

Technical effects of embodiments of the present disclosure include panels of a combustor that have recessed rails enabling improved impingement cooling at a circumferentially extending gap between the combustor panels and thus reducing burn back through the circumferentially extending gap.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1A:
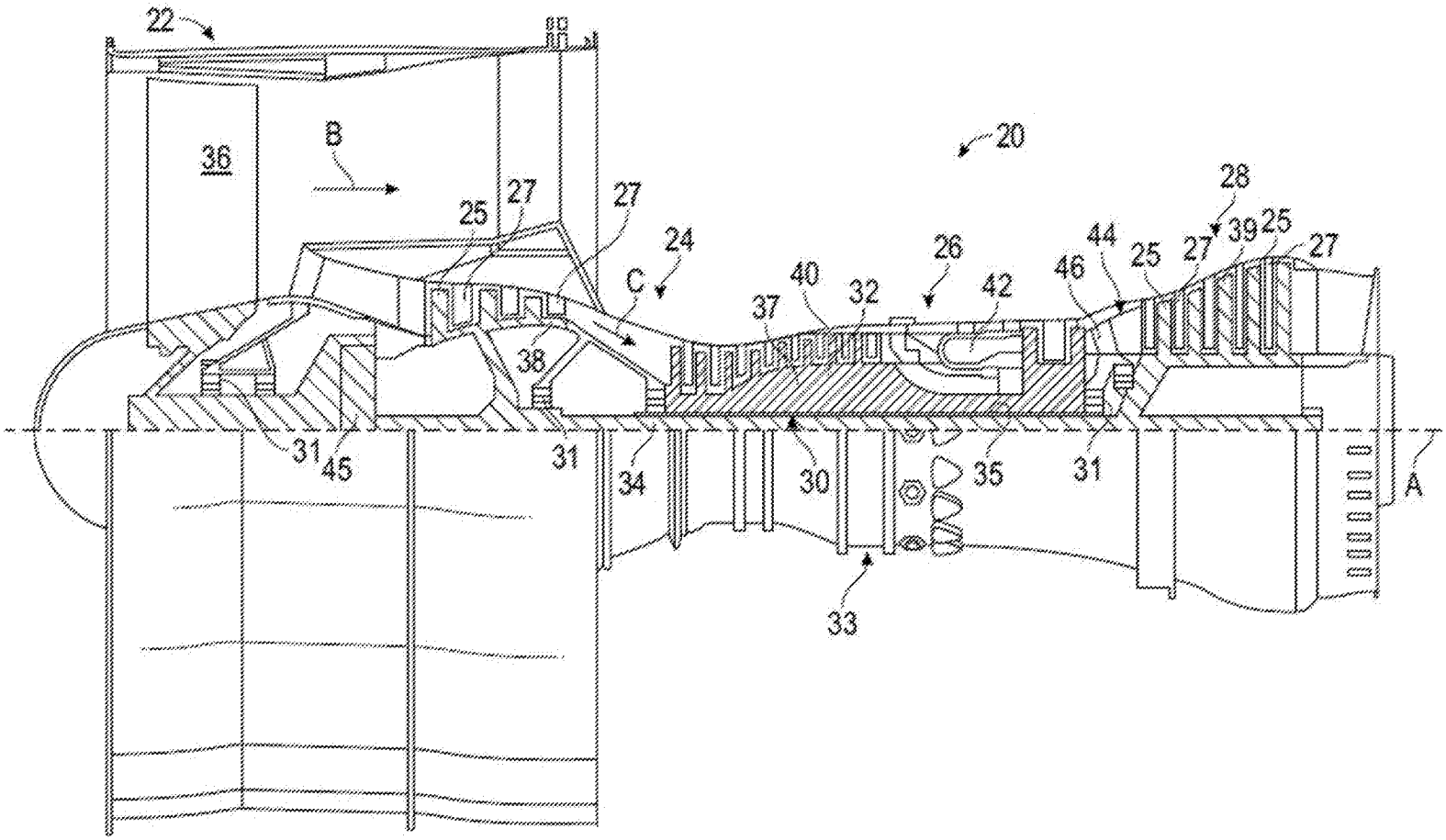
FIG. 1A is a schematic cross-sectional illustration of a gas turbine engine that may employ various embodiments disclosed herein.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1A schematically illustrates a gas turbine engine 20. The exemplary gas turbine engine 20 is a two-spool turbofan engine that generally incorporates a fan section 22, a compressor section 24, a combustor section 26, and a turbine section 28. Alternative engines might include an augmenter section (not shown) among other systems for features. The fan section 22 drives air along a bypass flow path B, while the compressor section 24 drives air along a core flow path C for compression and communication into the combustor section 26. Hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, three-spool engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be pressure measured prior to the inlet of the low pressure turbine 39 as related to the pressure at the outlet of the low pressure turbine 39 and prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only examples of one embodiment of a geared architecture engine and that the present disclosure is applicable to other gas turbine engines, including direct drive turbofans.

In this embodiment of the example gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet (10,668 meter). This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $[(T_{ram}° R)/(518.7° R)]^{0.5}$, where $T_{ram}$ represents the ambient temperature in degrees Rankine. The Low Corrected Fan Tip Speed according to one non-limiting embodiment of the example gas turbine engine 20 is less than about 1150 feet per second (fps) (351 meters per second (m/s)).

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 of the rotor assemblies create or extract energy (in the form of pressure) from the core airflow that is communicated through the gas turbine engine 20 along the core flow path C. The vanes 27 of the vane assemblies direct the core airflow to the blades 25 to either add or extract energy.

Figure 1B:
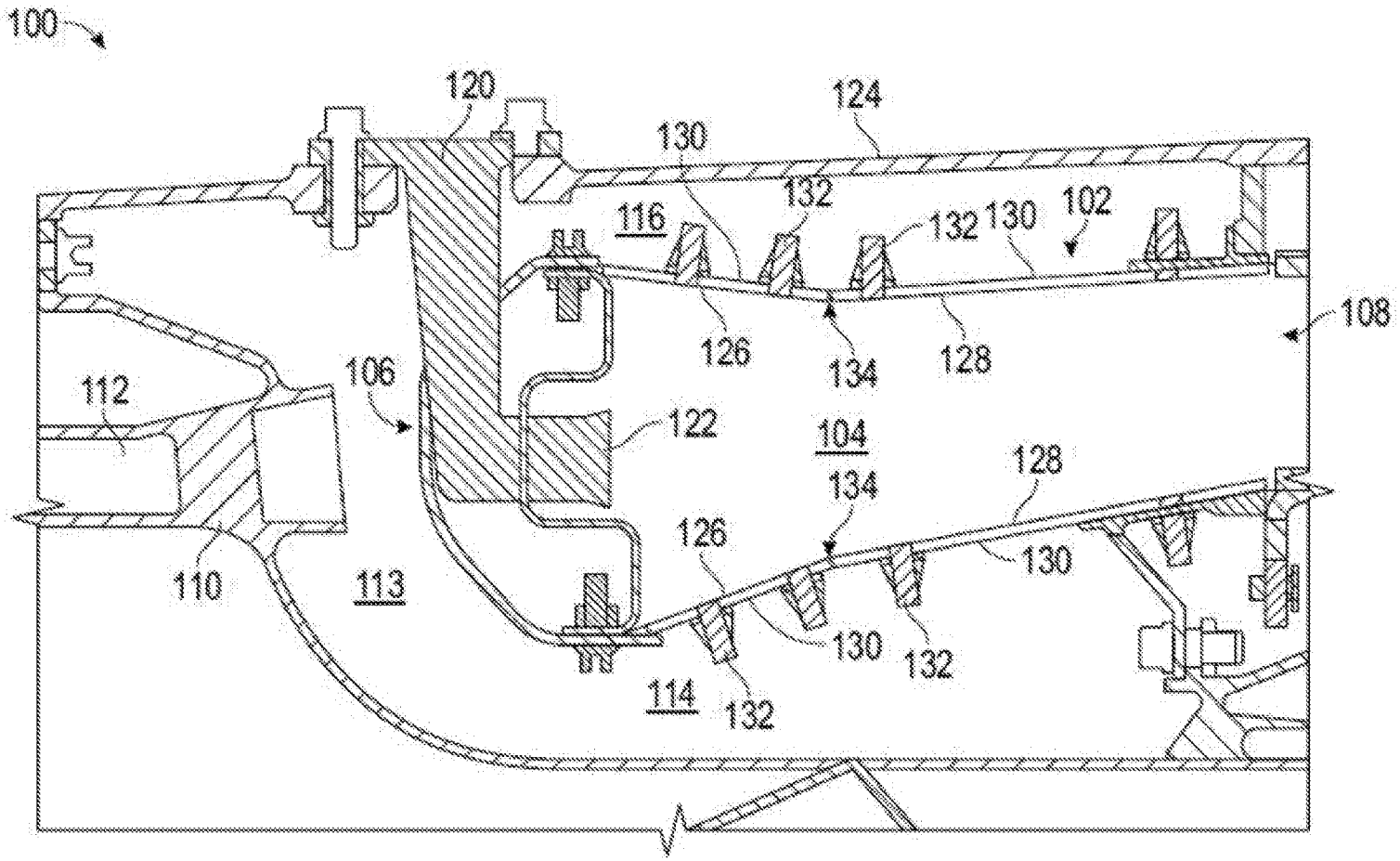
FIG. 1B is a schematic illustration of a combustor section of a gas turbine engine that may employ various embodiments disclosed herein.

FIG. 1B is a schematic illustration of a configuration of a combustion section of an engine. As shown, an engine 100 includes a combustor 102 defining a combustion chamber 104. The combustor 102 includes an inlet 106 and an outlet 108 through which air may pass. The air may be supplied to the combustor 102 by a pre-diffuser 110.

In the configuration shown in FIG. 1B, air may be supplied from a compressor into an exit guide vane 112. The exit guide vane 112 is configured to direct the airflow into the pre-diffuser 110, which then directs the airflow toward the combustor 102. The combustor 102 and the pre-diffuser 110 are separated by a shroud chamber 113 that contains the combustor 102 and includes an inner diameter branch 114 and an outer diameter branch 116. As air enters the shroud chamber 113 a portion of the air may flow into the combustor inlet 106, a portion may flow into the inner diameter branch 114, and a portion may flow into the outer diameter branch 116. The air from the inner diameter branch 114 and the outer diameter branch 116 may then enter the combustion chamber 104 by means of one or more nozzles, holes, apertures, etc. The air may then exit the combustion chamber 104 through the combustor outlet 108. At the same time, fuel may be supplied into the combustion chamber 104 from a fuel injector 120 and a pilot nozzle 122, which may be ignited within the combustion chamber 104. The combustor 102 of the engine 100 may be housed within a shroud case 124 which may define the shroud chamber 113.

The combustor 102 may be formed of one or more panels 126, 128 that are mounted on an interior surface of one or more shells 130 and parallel thereto. The panels 126, 128 may be removably mounted to the shell 130 by one or more attachment mechanisms 132. In some embodiments, the attachment mechanism 132 may be integrally formed with a respective panel 126, 128, although other configurations are possible. In some embodiments, the attachment mechanism 132 may be a bolt or other structure that may extend from the respective panel 126, 128 through the interior surface to a receiving portion or aperture of the shell 130 such that the panel 126, 128 may be attached to the shell 130 and held in place.

The panels 126, 128 may include a plurality of cooling holes and/or apertures to enable fluid, such as gases, to flow from areas external to the combustion chamber 104 into the combustion chamber 104. Impingement cooling may be provided from the shell-side of the panels 126, 128, with hot gases may be in contact with the combustion-side of the panels 126, 128. That is, hot gases may be in contact with a surface of the panels 126, 128 that is facing the combustion chamber 104.

First panels 126 may be configured about the inlet 106 of the combustor 102 and may be referred to as forward panels. Second panels 128 may be positioned axially rearward and adjacent the first panels 126, and may be referred to as aft panels. The first panels 126 and the second panels 128 are configured with a gap 134 formed between axially adjacent first panels 126 and second panels 128. The gap 134 may be a circumferentially extending gap that extends about a circumference of the combustor 102. A plurality of first panels 126 and second panels 128 may be attached and extend about an inner diameter of the combustor 102, and a separate plurality of first and second panels 126, 128 may be attached and extend about an outer diameter of the combustor 102, as known in the art. As such, axially extending gaps may be formed between two circumferentially adjacent first panels 126 and between two circumferentially adjacent second panels 128.

Figure 1C:
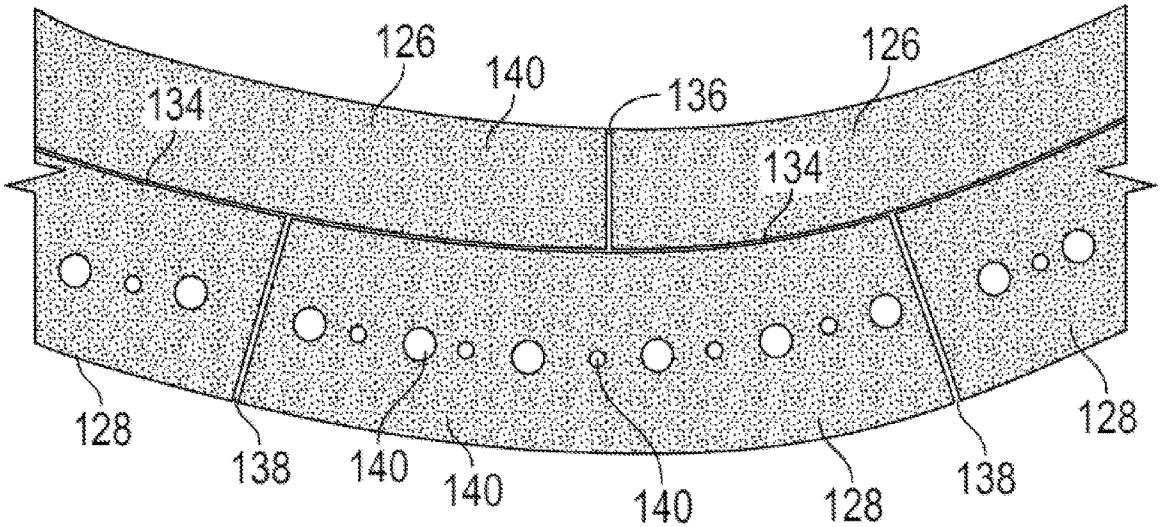
FIG. 1C is a schematic illustration of panels of a gas turbine engine that may employ various embodiment disclosed herein.

Turning now to FIG. 1C, an illustration of a configuration of panels 126, 128 installed within a combustor 102 is shown. The first panels 126 are installed to extend circumferentially about the combustion chamber 104 and form first axially extending gaps 136 between circumferentially adjacent first panels 126. Similarly, the second panels 128 are installed to extend circumferentially about the combustion chamber 104 and second axially extending gaps 138 are formed between circumferentially adjacent second panels 128. Moreover, as shown, the circumferentially extending gap 134 is shown between axially adjacent first and second panels 126, 128. Also shown in FIG. 1C are the various cooling holes, apertures, and other fluid flow paths 140 that are formed in the surfaces of the panels 126, 128.

The gaps 134, 136, and 138 may enable movement and/or thermal expansion of various panels 126, 128 such that room is provided to accommodate such movement and/or changes in shape or size of the panels 126, 128. Leakage or purge gases may flow into the combustion chamber 104 through the gaps 134, 136, and 138. In some embodiments, cooling flow may be provided to an exterior side of the panels 126, 128 to provide cooling to the combustor 102. Flowing in the opposite direction, hot gas may ingest or flow from the combustion chamber 104 outward through the gaps 134, 136, and 138. Hot gas injecting through the gaps 134, 136, and 138 may cause damage and/or wear on the material of the panels 126, 128.

Figure 2:
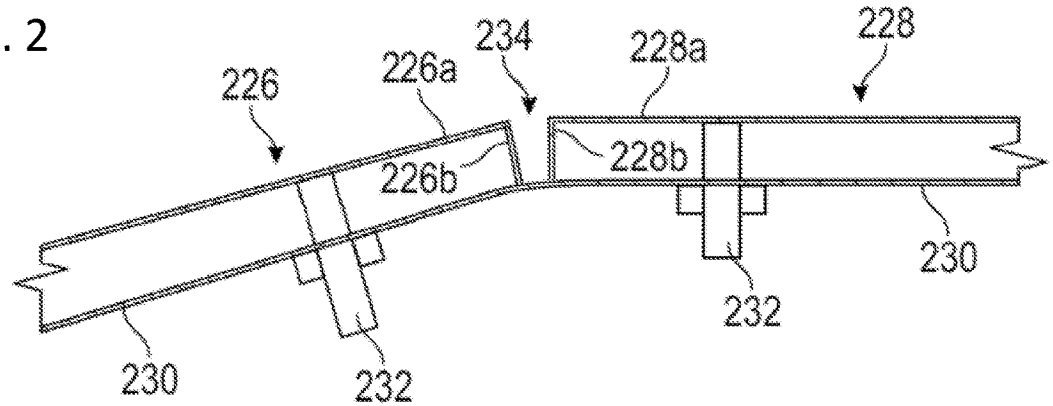
FIG. 2 is a side view schematic illustration of two adjacent combustor panels.

Turning now to FIG. 2, a side view of a circumferentially extending gap 234 formed between a first panel 226 and a second panel 228 is shown. As shown, the first panel 226 includes a first panel combustion chamber surface 226*a* and a first panel rail 226*b* extending from the combustion chamber surface 226*a* to touch or contact a combustor shell 230. As installed, the first panel combustion chamber surface 226*a* defines a wall of a combustion chamber that is parallel with the interior surface of the shell 230 and the first panel rail 226*b* extends outwardly and away from the combustion chamber toward the shell 230 to which the first panel 226 is mounted. As shown, an attachment mechanism 232 is configured to mount the first panel 226 to the shell 230. The shell 230 may have an interior surface that defines, in part, a combustion chamber (e.g., combustion chamber 104 shown in FIG. 1B).

Similarly, the second panel 228 includes a second panel combustion chamber surface 228*a* and a second panel rail 228*b* extending from the combustion chamber surface 228*a* to touch or contact the combustor shell 330. As installed, the second panel combustion chamber surface 228*a* defines a wall of a combustion chamber that is parallel with the interior surface of the shell 230 and the second panel rail 228*b* extends outwardly and away from the combustion chamber toward a shell 230 to which the second panel 228 is mounted. As shown, an attachment mechanism 232 is configured to mount the second panel 228 to the shell 230. The circumferentially extending gap 234 is formed between the first and second panels 226, 228 and may be large because of the respective rails 226*b*, 228*b* because it may be desirable to not have the panels 226, 228 in contact with each other.

As shown, the rails 226*b*, 228*b* are configured perpendicular to the respective combustion chamber surfaces 226*a*, 228*a*. As shown, the rails 226*b*, 228*b* touch or contact the shell 230. However, those of skill in the art will appreciate that the rails are not required to touch or contact the shell.

Leakage or purge gas may flow upward in FIG. 2, moving from below the panels 226, 228 and into a combustion chamber through the circumferentially extending gap 234. However, hot gas may entrain into the circumferentially extending gap 234 which may result in burn back oxidation distress on the first rail 226*b* of the first panel 226 and the second rail 228*b* of the second panel 228*b*. Accordingly, panel configurations having mechanisms for preventing entrainment and burn back may be advantageously and improve panel life.

Figure 3A:
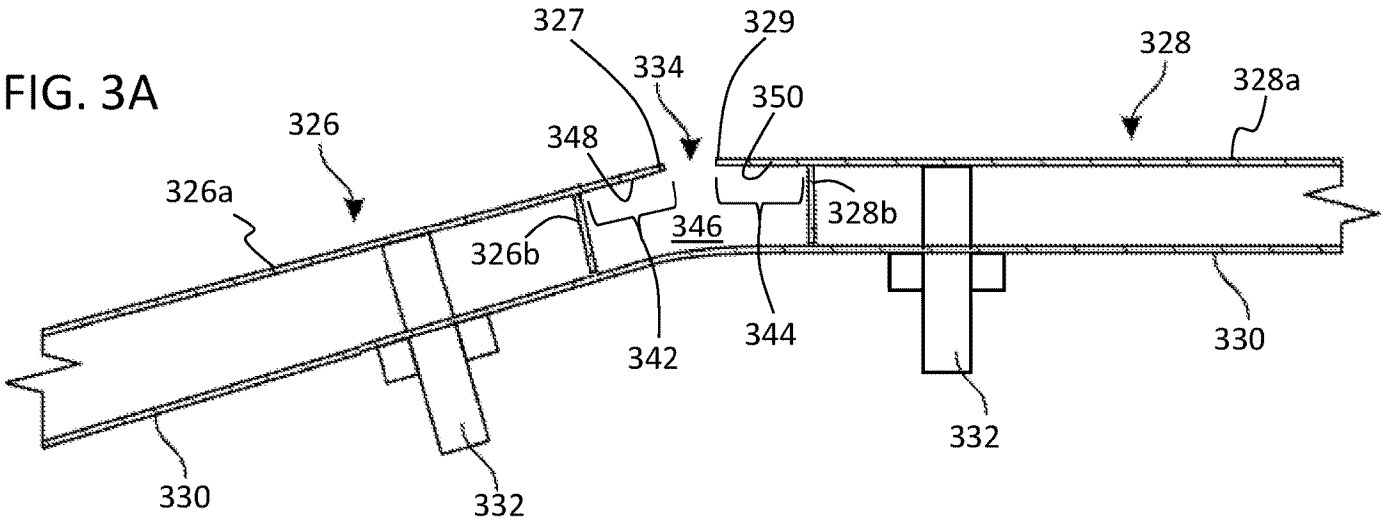
FIG. 3A is a side view schematic illustration of two adjacent combustor panels in accordance with an embodiment of the present disclosure.
Figure 3B:
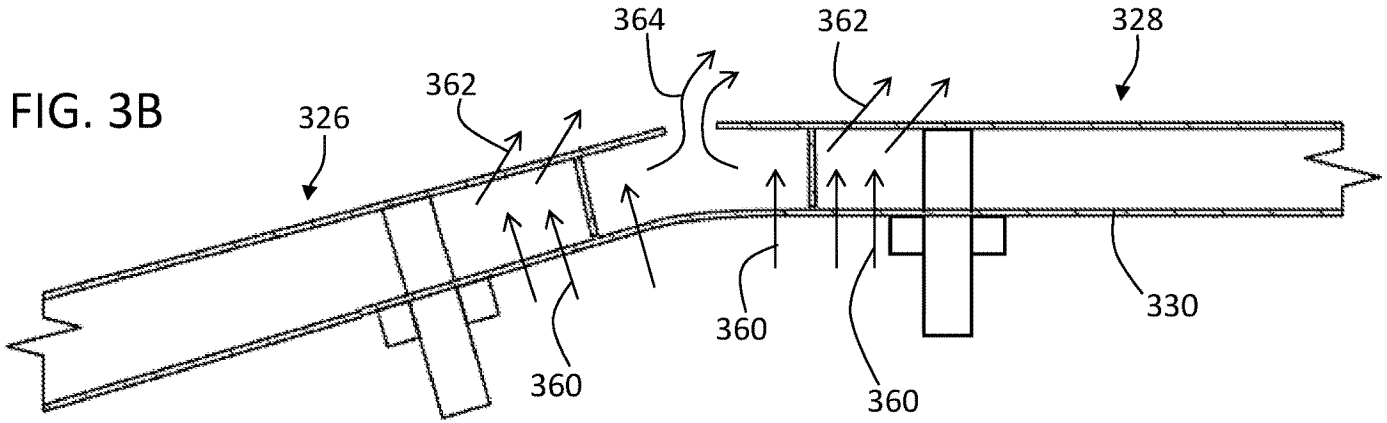
FIG. 3B is a side view schematic illustration of the combustor panels of FIG. 3A indicating a fluid flow therethrough.

Turning now to FIGS. 3A-3B, schematic illustrations of an embodiment in accordance with the present disclosure is shown. FIG. 3A shows a combustion chamber configuration in accordance with an embodiment of the present disclosure and FIG. 3B shows airflow through the features shown and described with respect to FIG. 3A. A first panel 326 is formed having a first combustion chamber surface 326*a* and a first rail 326*b*. A second panel 328 is formed having a second combustion chamber surface 328*a* and a second rail 328*b*. As shown, the first and second panels 326, 328 are supported above a shell 330 by attachment mechanisms 332. A circumferentially extending gap 334 is formed between the first panel 326 and the second panel 328.

As shown, the first rail 326*b* is recessed with respect to a first end 327 of the first panel 326. The recess is defined, in part, by a first extension 342 that extends the first combustion chamber surface 326*a* axially past or beyond the first rail 326*b*. Or, stated in another way, the first rail 326*b* is located between the end 327 of the first panel 326 and an attachment mechanism 332 of the first panel 326. Similarly, the second rail 328*b* is recessed with respect to a second end 329 of the second combustion chamber surface 328*a*. The recess is defined, in part, by a second extension 344 that extends the second combustion chamber surface 328*a* axially past the second rail 328*b*. The first and second extensions 342, 344 and the first and second rails 326*b*, 328*b* partially define an impingement cooling volume 346.

The first extension 342 defines a first impingement cooling surface 348 that is a surface that defines, in part, the impingement cooling volume 346. Similarly, the second extension 344 defines a second impingement cooling surface 350 that is a surface that defines, in part, the impingement cooling volume 346. The first and second impingement cooling surfaces 348, 350 provide surface area to the panels 326, 328, respectively, for impingement cooling to minimize the impact of hot gas entrainment through the circumferentially extending gap 334.

As shown in FIG. 3B, in this embodiment, leakage flow, flowing from the exterior of a combustion chamber into a combustion chamber, i.e., upward through the circumferentially extending gap 334 in FIG. 3A, may be increased, and the amount of impingement cooling at the ends 327, 329 of the panels 326, 328, respectively, may be increased. That is, for example, because a distance between the first rail 326*b* and the second rail 328*b* is increased (as compared to the configured in FIG. 2) air flowing to and through the circumferentially extending gap 334 may be increased and provide increased airflow and cooling at the circumferentially extending gap 334 and the extensions 342, 344.

As shown in FIG. 3B, impingement cooling 360 may flow from below and through the shell 330 into the volume defined between the shell 330 and the panels 326, 328. As will be appreciated by those of skill in the art, effusion holes may be formed in the panels 326, 328, and effusion cooling 362 may flow from below the panels 326, 328 and into the combustion chamber. Further, as noted above, because of the location of the rails 326*b*, 328*b* and the formation of the impingement cooling volume 346, an increased effusion cooling 364 is generated at the ends 327, 329 of the panels 326, 328. The increased effusion cooling 364 can prevent blow back or entrainment of hot combustor air from entering the impingement cooling volume 346 formed between adjacent panels 326, 328.

Figure 4:
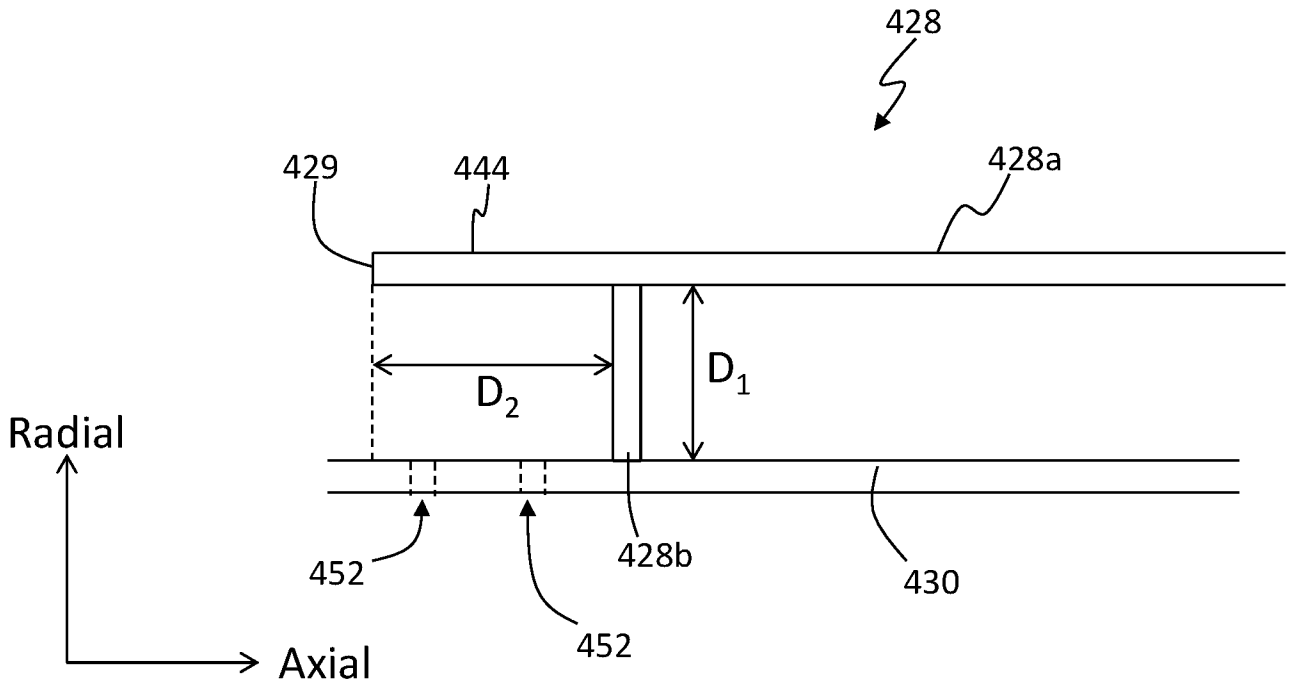
FIG. 4 is an enlarged schematic illustration of a panel having a recessed rail in accordance with an embodiment of the present disclosure.

Turning now to FIG. 4, an enlarged schematic illustration of a panel having a rail configured in accordance with an embodiment of the present disclosure is shown. As shown, a panel 428 includes a combustion chamber surface 428*a* extending in an axial direction, e.g., along an axis of a combustion engine. Further, the panel 428 includes a rail 428*b* extending radially inward from the combustion chamber surface 428*a*. An extension 444 extends from the location of the rail 428*b* axially to a first end 429 of the panel 428.

The rail 428*b* is defined in part by a first distance $D_1$ defining a radial distance of extension of the rail 428*b* from the combustion chamber surface 428*a* (i.e., a length or height of the rail 428*b*). As shown, the rail 428*b* is offset from the end 429 of the panel 428 by a second distance $D_2$. In accordance with some non-limiting embodiments, the location of the rail 428*b* relative to the end 429 of the panel 428 (i.e., second distance $D_2$) may be defined as a location that is between one quarter (¼) and seven (7) rail lengths (i.e., first distance $D_1$). In one non-limiting embodiment, the second length $D_2$ may be between 0.08 inches (0.20 cm) and 0.12 inches (0.31 cm).

Also shown in FIG. 4, a shell 430 may include one or more optional impingement apertures 452 formed in the space between the rail 428*b* and the end 429 of the panel 429. The impingement apertures 452 may allow for air to bleed through the shell 430 to aid in cooling and/or airflow control through a circumferentially extending gap between panels of a combustor. As noted, the one or more impingement apertures 452 are optional, and in some embodiments, the impingement apertures 452 may be omitted.

Advantageously, embodiments described herein provide panels in a combustor of a gas turbine engine having improved impingement cooling due to increased surface areas at circumferentially extending gaps of combustor panels. Moreover, a more effective purge mechanism may be provided for a leakage flow of the panels of the combustor by increasing an amount of cooling air located at the circumferentially extending gaps of the combustor panels.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the spirit and scope of the present disclosure. Additionally, while various embodiments of the present disclosure have been described, it is to be understood that aspects of the present disclosure may include only some of the described embodiments.

For example, although various configurations are provided herein, those of skill in the art will appreciate that angled rails may be employed without departing from the scope of the present disclosure. Further, for example, although described with respect to the circumferentially extending gap of the combustor, those of skill in the art will appreciate that recessed rails may be configured on panels that form axially extending gaps. Further, although shown with two adjacent panels (in the axial direction) each have an extension, as provided herein, those of skill in the art will appreciate that only one panel may have a panel (and recessed rail) and the other panel may have a rail positioned at the end of the panel.

Accordingly, the present disclosure is not to be seen as limited by the foregoing description, but is only limited by the scope of the appended claims.

What is claimed is:

1. A method of manufacturing a combustor of a gas turbine engine comprising:

mounting a first panel to an interior surface of a combustor shell at a first position, the combustor shell defining a combustion chamber, the first panel comprising:

a first end;

a first rail proximate the first end;

a first combustion chamber surface extending axially within the combustion chamber from the first rail to an axially opposite end of the first panel, the first combustion chamber surface being parallel with the interior surface of the combustor shell, the first rail extending from the first combustion chamber surface toward the interior surface of the combustor shell; and a first extension of the first combustion chamber surface extending axially from the first rail to the first end of the first panel;

mounting a second panel to the interior surface of the combustor shell at a second position and axially adjacent to the first panel, the second panel comprising:

a second end;

a second rail proximate the second end;

a second combustion chamber surface extending from the second rail to an axially opposite end of the second panel, the second rail extending from the second combustion chamber surface toward the interior surface of the combustor shell; and a second extension of the second combustion chamber surface extending axially from the second rail to the second end of the second panel, wherein the first end and the second end are proximal to each other and define a circumferentially extending gap therebetween, wherein the first rail, the second rail, the first extension, and the second extension collectively define an impingement cooling volume at the circumferentially extending gap, and wherein the combustor shell includes at least one impingement aperture proximate the circumferentially extending gap, the at least one impingement aperture being configured to provide impingement cooling air to the impingement cooling volume.

2. The method of claim 1, wherein the first rail extends a first distance from the first combustion chamber surface toward the interior surface of the combustor shell, and the first extension extends a second distance, wherein the second distance is between one quarter and seven times the first distance.

3. A combustor for a gas turbine engine comprising:

a combustor shell having an interior surface and defining a combustion chamber having an axial length;

a first panel mounted to the interior surface of the combustor shell at a first position, the first panel having comprising:

a first end;

a first rail proximate the first end;

a first combustion chamber surface extending axially within the combustion chamber from the first rail to an axially opposite end of the first panel, the first combustion chamber surface being parallel with the interior surface of the combustor shell, the first rail extending from the first combustion chamber surface toward the interior surface of the combustor shell; and a first extension of the first combustion chamber surface extending axially from the first rail to the first end of the first panel;

a second panel mounted to the interior surface of the combustor shell at a second position and axially adjacent to the first panel, the second panel comprising:

a second end;

a second rail proximate the second end;

a second combustion chamber surface extending from the second rail to an axially opposite end of the second panel, the second rail extending from the second combustion chamber surface toward the interior surface of the combustor shell; and a second extension of the second combustion chamber surface extending axially from the second rail to the second end of the second panel, wherein the first end of the first panel and the second end of the second panel are proximal to each other and define a circumferentially extending gap therebetween, wherein the first rail, the second rail, the first extension, and the second extension collectively define an impingement cooling volume at the circumferentially extending gap, and wherein the combustor shell includes at least one impingement aperture proximate the circumferentially extending gap, the at least one impingement aperture being configured to provide impingement cooling air to the impingement cooling volume.

4. The combustor of claim 3, wherein the first rail extends a first distance from the first combustion chamber surface toward the interior surface of the combustor shell, and the first extension extends a second distance, wherein the second distance is between one quarter and seven times the first distance.

5. The combustor of claim 3, wherein the first extension has a length of between 0.08 inches and 0.12 inches.

6. The combustor of claim 3, further comprising a plurality of first panels and a plurality of second panels, wherein circumferentially adjacent panels of the plurality of first panels define respective axially extending gaps therebetween and wherein circumferentially adjacent panels of the plurality of second panels define respective axially extending gaps therebetween.

7. The combustor of claim 6, wherein each first panel of the plurality of first panels includes at least one axially extending rail that extends from the first rail along the axially extending gap.

8. A gas turbine engine comprising:

a combustor including a combustor shell, the combustor shell having an interior surface and defining a combustion chamber having an axial length;

a first panel mounted to the interior surface of the combustor shell at a first position, the first panel comprising:

a first end;

a first rail proximate the first end;

a first combustion chamber surface extending axially within the combustion chamber from the first rail to an axially opposite end of the first panel, the first combustion chamber surface being parallel with the interior surface of the combustor shell, the first rail extending from the first combustion chamber surface toward the interior surface of the combustor shell; and a first extension of the first combustion chamber surface extending axially from the first rail to the first end of the first panel;

a second panel mounted to the interior surface of the combustor shell at a second position and axially adjacent to the first panel, the second panel comprising:

a second end;

a second rail proximate the second end;

a second combustion chamber surface extending from the second rail to an axially opposite end of the second panel, the second rail extending from the second combustion chamber surface toward the interior surface of the combustor shell; and a second extension of the second combustion chamber surface extending axially from the second rail to the second end of the second panel, wherein the first end of the first panel and the second end of the second panel are proximal to each other and define a circumferentially extending gap therebetween, wherein the first rail, the second rail, the first extension, and the second extension collectively define an impingement cooling volume at the circumferentially extending gap, and wherein the combustor shell includes at least one impingement aperture proximate the circumferentially extending gap, the at least one impingement aperture being configured to provide impingement cooling air to the impingement cooling volume.

9. The gas turbine engine of claim 8, wherein the first rail extends a first distance from the first combustion chamber surface toward the interior surface of the combustor shell, and the first extension extends a second distance, wherein the second distance is between one quarter and seven times the first distance.

10. The gas turbine engine of claim 8, wherein the first extension has a length of between 0.08 inches and 0.12 inches.

11. The gas turbine engine of claim 8, further comprising a plurality of first panels and a plurality of second panels, wherein circumferentially adjacent panels of the plurality of first panels define respective axially extending gaps therebetween and wherein circumferentially adjacent panels of the plurality of second panels define respective axially extending gaps therebetween.

12. The gas turbine engine of claim 11, wherein each first panel of the plurality of first panels includes at least one axially extending rail that extends from the first rail along the axially extending gap.

* * * * *